United States Patent [19]

Jones

[11] 4,442,776

[45] Apr. 17, 1984

[54] DETONATOR BLOCK

[75] Inventor: Bruce B. Jones, Mt. Aukum, Calif.

[73] Assignee: The United States of America as represented by the Secretary of the Air Force, Washington, D.C.

[21] Appl. No.: 370,232

[22] Filed: Apr. 21, 1982

[51] Int. Cl.[3] ..... F42C 19/08

[52] U.S. Cl. ..... 102/275.12

[58] Field of Search ..... 102/275.7, 275.12, 202.1, 102/200, 275.6, 275.11

[56] References Cited

U.S. PATENT DOCUMENTS

| | | | |
|---|---|---|---|
| 2,878,752 | 3/1959 | Johnson et al. | 102/202.13 |
| 3,175,491 | 3/1965 | Robertson | 102/275.7 |
| 3,205,818 | 9/1965 | Coulson | 102/275.7 |
| 4,024,817 | 5/1977 | Calder, Jr. et al. | 102/275.7 |
| 4,187,780 | 2/1980 | Petrucelli | 102/275.12 |

FOREIGN PATENT DOCUMENTS

| | | | |
|---|---|---|---|
| 136056 | 12/1929 | Switzerland | 102/200 |

*Primary Examiner*—Charles T. Jordan

*Attorney, Agent, or Firm*—Donald J. Sing; Frank J. Lamattina

[57] ABSTRACT

A detonator block which permits the explosion of a primary detonator and the resultant explosion of an associated primary detonating cord, but which at the same time prevents damage to or explosion of an adjacent secondary detonator and its associate secondary detonating cord.

6 Claims, 2 Drawing Figures

DETONATOR BLOCK

STATEMENT OF GOVERNMENT INTEREST

The invention described herein may be manufactured and used by or for the Government for governmental purposes without the payment of any royalty thereon.

BACKGROUND OF THE INVENTION

The instant invention relates to the detonation art and, more particularly, to a uniquely structured detonator block.

It is well known in the art that, when the primary detonating cord of a two-cord separation detonating system is ignited by the primary detonator, the secondary detonating cord of the system may be separated, damaged or unintentionally detonated with possible catastrophic results.

In the prior art, attempts to solve this problem have included fastening down the detonating cord with a clip and screws, coupled with the use of a removable separation barrier between the primary and secondary detonating cords. It is fair and accurate to say the these prior art attempts have failed.

Therefore, what is presently needed in the art, and is still not available, is a means for permitting the detonation of a primary detonating cord without adversely affecting the undetonated secondary detonating cord.

SUMMARY OF THE INVENTION

The instant invention fullfills the above-mentioned need, and thereby constitutes a significant advance in the state of the art, by providing a uniquely structured detonator which, after the explosion of the primary detonator and the ignition of the primary detonating cord, allows venting of the products of combustion and results in the collapse of an energy absorbing constituent portion of the block, thereby substantially reducing the resultant pressure that is typically exerted on the secondary detonating cord. This reduction in pressure is sufficient to preclude damage to, or ignition of, the secondary detonating cord.

Accordingly, it is an object of the instant invention to provide a detonator block capable of accepting a plurality of separated detonators which may be individually exploded, with each detonator having a different detonating cord associated with and explodible by that detonator.

It is another object of this invention to provide a suitable means for reducing the pressure and shock of the explosion of the primary detonator.

It is still another object of the instant invention to provide novel means for venting the products of combustion of the primary detonator, thereby resulting in substantially reducing the pressure and shock forces exerted on any detonating cord held by the detonator block, other than the primary detonating cord.

It is yet another object of this invention to provide means for permitting the capture and the expansion of the gaseous products of combustion resulting from the explosion of the primary detonator, thereby preventing these products from coming in contact with any detonating cord, other than the primary detonating cord.

It is a further object of the instant invention to provide novel means for absorbing energy, as a result of the ignition of the primary detonator, thereby resulting in the substantial reduction of energy imparted to any detonating cord, other than the primary detonating cord.

These objects of the instant invention, as well as others related thereto (e.g., simplicity of structure, ease of use, economy of manufacture, and reliability in use), will become readily apparent after a consideration of the description of the instant invention, coupled with reference to the contents of the Figures of the drawing.

DESCRIPTION OF THE PREFERRED EMBODIMENT

Figure 1:
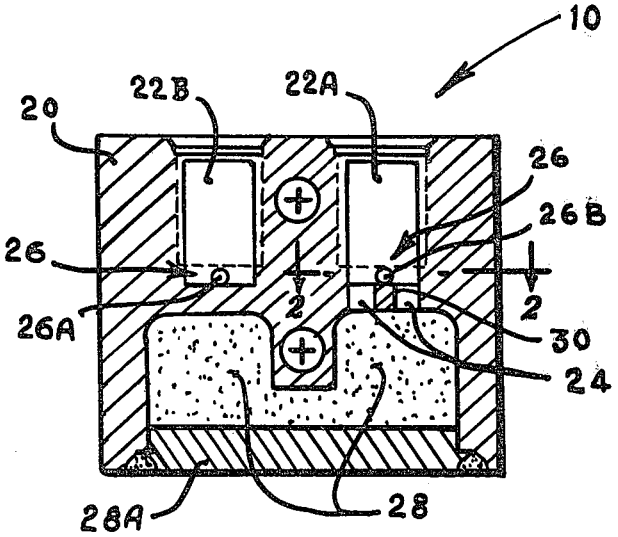
FIG. 1 is a side elevation view, in simplified pictorial and schematic form and in cross section, of the preferred embodiment of the instant invention.
Figure 2:
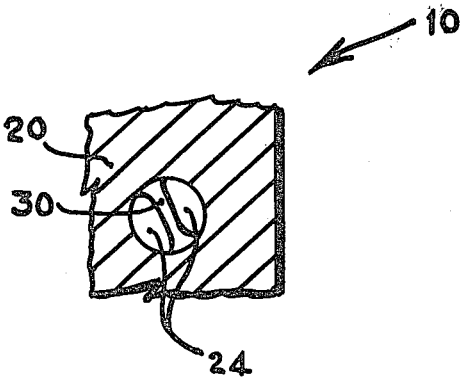
FIG. 2 is the view of the portion of the preferred embodiment as seen along line 2—2 in FIG. 1, in simplified pictorial and schematic form and partially fragmented.

With reference to FIGS. 1 and 2, therein is shown the preferred embodiment 10 of the instant invention, a detonator block.

The preferred embodiment 10, in the most basic and generic structural form, comprises a detonator block 20, preferably made of aluminum, having: a plurality of adjacent separated ports (such as 22A and 22B, FIG. 1) for detonators (not shown), with one of the ports (such as 22A) having an outlet or vent (such as 24, FIGS. 1 and 2); means (generally designated 26, FIG. 1) for supporting a different detonating cord (not shown) adjacent each different port of the plurality of ports; a cavity (such as 28, FIG. 1) in communication with the outlet or vent 24 of port 22A; and a bridge portion (such as 30, FIGS. 1 and 2) spanning the outlet or vent 24 of the port 22A.

As a matter of preference and not of limitation, the adjacent separated ports for the detonators are two (2) in number, i.e., a primary detonator port 22A for a primary detonator (not shown) which would be journalled in that port 22A, and a secondary detonator port 22B for a secondary detonator (not shown) which would be journalled in that port 22B, with the primary detonator port 22A having the aforementioned outlet or vent 24.

The means 26 for supporting a different detonating cord adjacent each different detonator port 22A and 22B includes: a first passageway (such as 26A, FIG. 1) through the detonator block 20 positioned transverse to and adjacent to the floor of the secondary detonator port 22B; and, a second passageway (such as 26B, FIG. 1) through the detonator block 20 positioned transverse to and adjacent to the floor of the primary detonator port 22A, with this second passageway 26B being concurrently positioned between the bridge portion 30 spanning the outlet or vent 24 of the primary detonator port 22A, and the floor of the primary detonator port 22A.

Although the preferred embodiment 10 may comprise a detonator block 20 of one-piece, the detonator block 20 is preferably of a two-piece integrated unit, as is shown in FIG. 1. More specifically, it is preferred that the floor of the cavity 28 be removably connectable by the use of a plug-like member, such as 28A. In this regard, assuming that the remainder of the block is made of aluminum, then it is preferred that the plug-like member 28A also be made of aluminum.

MANNER OF OPERATION AND OF USE OF THE PREFERRED EMBODIMENT

The manner of operation, and of use, of the preferred embodiment 10, FIGS. 1 and 2, of the instant invention can be easily ascertained by any person of ordinary skill in the art from the foregoing description, coupled with reference to the contents of the Figures of the drawing.

For others, the following explanation is given. The detonator block 20, when in use, houses two detonators (not shown), with the primary detonator being fitted into primary detonator port 22A, and with the secondary detonator being fitted into primary detonator port 22B. It is here to be noted that the secondary detonator may be either the only detonator scheduled to be exploded (with the secondary detonator being redundant and held in reserve, to be used if the primary malfunctions), or the primary detonator may be the first in the sequence of the two detonators to be exploded (with the secondary detonator being the second in the sequence to be used). Whatever the reason for the presence and availability of the primary and the secondary detonators, each detonator has an associated detonating cord. The primary detonating cord (for the primary detonator) is positioned in and through passageway 26B which is between the floor of detonator port 22A and the bridge portion 30, the secondary detonating cord (for the secondary detonator) is positioned in and through passageway 26A which is under and adjacent to the floor of detonator port 22B.

In this situation, and in this environment, it is the goal of the user to explode the primary detonator in the port 22A, and thereby to explode the primary detonating cord in passageway 26B, without damaging or exploding the secondary detonating cord in passageway 26A. If prior art devices are used, this goal may or may not be accomplished; whereas, with the use of the preferred embodiment 10 of the instant invention, this goal will be accomplished each and every time. More specifically, when the preferred embodiment 10 is used and the primary detonator is exploded, and the primary detonating cord thereby is exploded, part of the energy of explosion is absorbed by the bridge portion 30 which is located diametrically across the vent or outlet 24. The bridge portion 30 collapses, and concurrently the vent or outlet 24 allows gases from the detonation to enter into the cavity 28, to fill that cavity, and to dissipate within the cavity. As a result, the secondary detonating cord in passageway 26A, and the secondary detonator in port 22B, are thereby isolated from, and not involved with, the explosion of the primary detonating cord in passageway 26B.

CONCLUSION

It is abundantly clear from all of the foregoing, and from the contents of Figures of the drawing, that the stated objects of the instant invention, as well as other objects relative thereto, have been achieved.

It is to be noted that, although there have been described and shown the fundamental and unique features of the instant invention, as applied to a preferred embodiment 10, nevertheless various other embodiments, variations, adaptations, substitutions, additions, and the like may occur to and can be made by those of ordinary skill in the art.

What is claimed is:

1. A detonator block having a plurality of adjacent separated ports for detonators, with one of said ports having an outlet, means for supporting a different detonating cord adjacent each different port of said plurality of ports, a cavity in communication with said outlet of said port and a bridge portion spanning said outlet of said port.

2. A detonator block, as set forth in claim 1, wherein said plurality of adjacent separated ports for detonators comprises a primary detonator port having an outlet and a secondary detonator port.

3. A detonator block, as set forth in claim 2, wherein said means for supporting a different detonating cord adjacent each different port of said plurality of ports for detonators includes: a first passageway through said detonator block positioned transverse to and adjacent to the floor of said secondary detonator port; and, a second passageway through said detonator block positioned transverse to and adjacent to the floor of said primary detonator port, with this second passageway concurrently positioned between said bridge portion spanning said outlet of said primary detonator port, and the floor of the primary detonator port.

4. A detonator block, as set forth in claim 3, wherein the floor of said cavity is removably connected to said detonator block.

5. A detonator block, as set forth in claim 1, wherein said block is made of aluminum.

6. A detonator block, as set forth in claim 4, wherein said removably connected cavity floor is made of aluminum.

* * * * *